US007927260B1

(12) United States Patent
Stalka

(10) Patent No.: US 7,927,260 B1
(45) Date of Patent: Apr. 19, 2011

(54) DOUBLE-END PUNCHING AND EXERCISE BAG

(76) Inventor: Timothy M. Stalka, Aurora, IL (US)

( * ) Notice: Subject to any disclaimer, the term of this patent is extended or adjusted under 35 U.S.C. 154(b) by 0 days.

(21) Appl. No.: 12/591,422

(22) Filed: Nov. 18, 2009

(51) Int. Cl.
*A63B 21/00* (2006.01)

(52) U.S. Cl. ..... 482/83; 482/90; 482/84; 482/86; 482/85

(58) Field of Classification Search ..... 482/83–90
See application file for complete search history.

(56) References Cited

U.S. PATENT DOCUMENTS 426,944 A * 4/1890 Iovett ..... 482/89
1,119,635 A * 12/1914 Beach ..... 482/87

* cited by examiner

*Primary Examiner* — Jerome W Donnelly
(74) *Attorney, Agent, or Firm* — Dillis V. Allen, Esq.

(57) ABSTRACT

A double-end punching and exercise bag assembly and cable where the bag is vertically adjustable by extending the cable through the bag assembly and providing clamp assemblies at both ends of the bag assembly each having collet-like radial spring fingers activated by an axially movable threaded nut.

5 Claims, 3 Drawing Sheets

Fig. 4
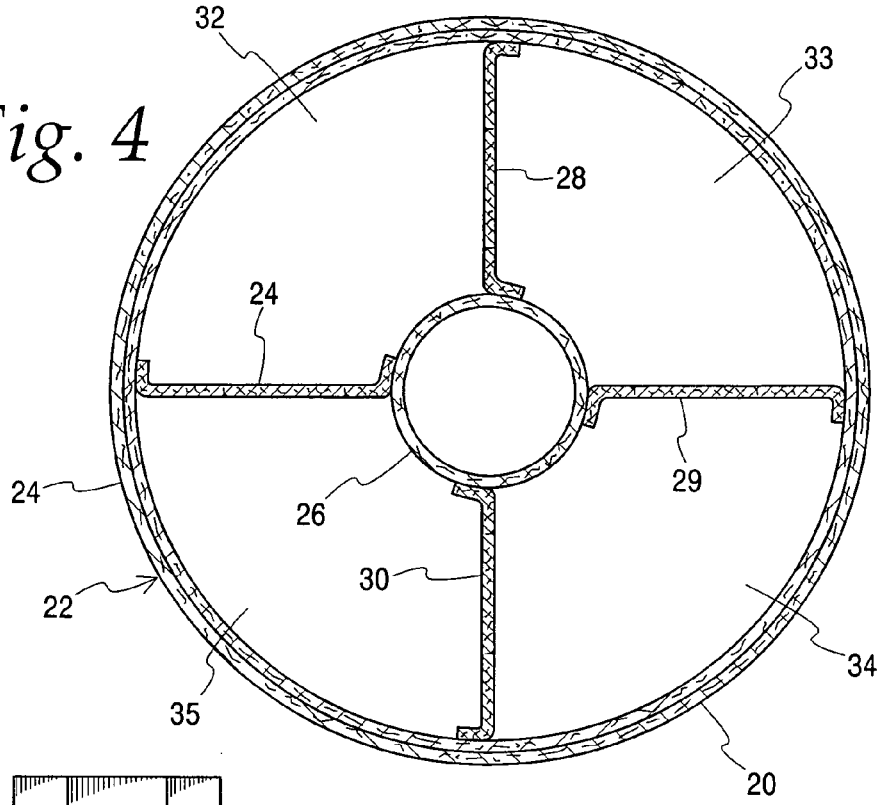
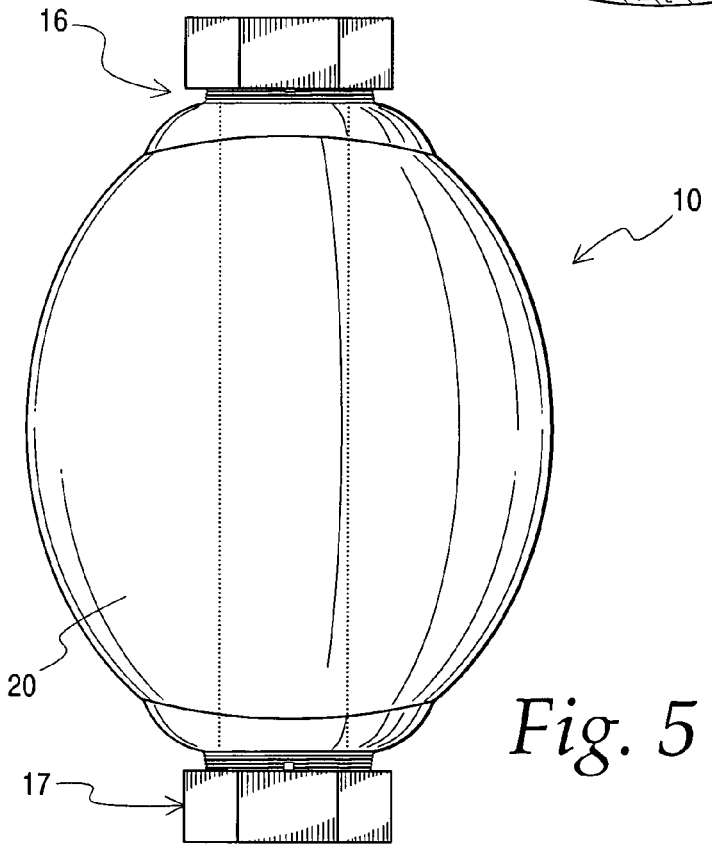
Fig. 5

DOUBLE-END PUNCHING AND EXERCISE BAG

BACKGROUND OF THE INVENTION

Double-end punching and exercise bag assemblies have been designed and implemented in gymnasiums and other athletic venues for many decades and generally include an air inflated bag assembly having a variety of spheroidal configurations suspended by two generally vertical cables, one attached to the top of the bag assembly and one attached to the bottom of the bag assembly, attached at their distal ends to generally stationary supports. Because these double-end punching bags, particularly in commercial environments, must be adapted to various anatomical configurations of the athletes, such as total height, arm reach, and other anatomical factors, it is necessary and desirable to provide a vertical adjustment to the punching bag assembly. This function has in the past been provided in a variety of ways including different length cables; i.e., the upper and lower cables supporting the bag assembly from fixed ceiling and floor mounted supports, adjustable shackles connecting the upper and lower cables to the bag itself and adjustable shackles supporting the distal ends of the two cables to the upper and lower fixed supports.

The principal problem with all of these prior adjustable assemblies is that they: (a) cannot be readily changed by the using athletes and require the assistance of a knowledgeable technician; and (b) the adjustability mechanisms in these prior designs are quite time-consuming to effect.

The applicant in this case has conducted a patentability search and has uncovered the following relevant patents relating to the adjustability of double end punching and exercise bags.

| Inventor | Patent No. | Issue Date |
|---|---|---|
| Aragona | 4,465,273 | Aug. 14, 1984 |
| Dye | 4,491,315 | Jan. 1, 1985 |
| Shustack | 4,635,929 | Jan. 13, 1987 |
| Donohue | 4,953,852 | Sep. 4, 1990 |
| Shic | 5,261,821 | Nov. 16, 1993 |
| Stephens | 5,503,606 | Apr. 2, 1996 |
| Zlojutro | 5,554,088 | Sep. 10, 1996 |
| Newman, et al. | 5,725,458 | Mar. 10, 1998 |
| Zagata, et al. | 5,769,761 | Jun. 23, 1998 |
| Hackaday | 6,743,157 | Jun. 1, 2004 |
| Iglehart | 7,044,895 | May 16, 2006 |
| Fields, et al. | 7,086,997 | Aug. 8, 2006 |

All of these patents show complicated and time-consuming mechanisms for adjusting the position of double-end punching bags with respect to the adjacent cable supporting mechanisms.

It is a primary object of the present invention to ameliorate the problems set forth above in double end punching and exercising bag assemblies.

SUMMARY OF THE PRESENT INVENTION

In accordance with the present invention, a double-end punching and exercise bag assembly and cable are provided where the bag is vertically adjustable by extending the cable through the bag assembly and providing clamp assemblies at both ends of the bag assembly each having collet-like radial spring fingers activated by an axially movable threaded nut.

The advantages of the present invention are manifold. Firstly, a single cable is provided instead of two in prior designs. Next, the bag assembly in the present invention is much more rapidly adjusted because it does not require the disconnection or manipulation of the cable as is required in earlier designs. Further, the collet-like clamps are rapidly activated and released without the removal of any parts.

Other objects and advantages of the present invention will appear more clearly from the following detailed description.

BRIEF DESCRIPTION OF THE DRAWINGS

FIG. 4 is a horizontal cross-section through the center of the bag assembly illustrated in FIGS. 1 and 2, and;

FIG. 5 is an assembled front view of the bag assembly illustrated in FIG. 2.

DETAILED DESCRIPTION OF THE PREFERRED EMBODIMENT

Figure 1:
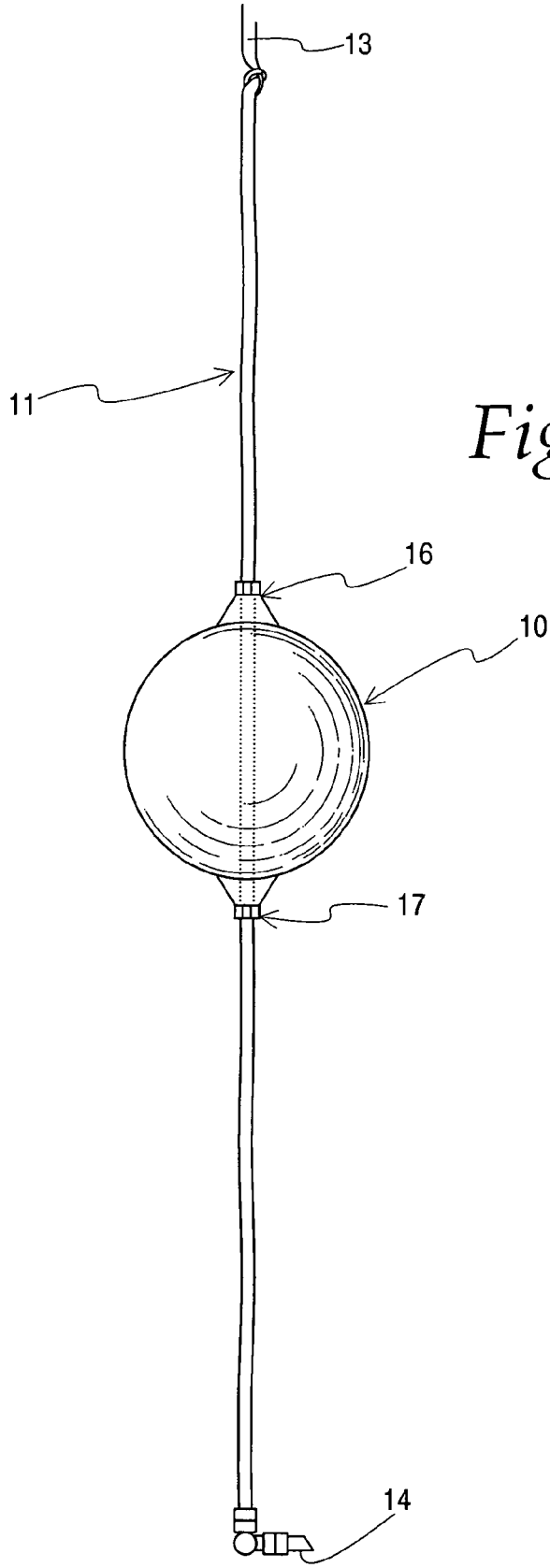
FIG. 1 is a front view of the present double-end punching and exercise bag assembly and the supporting cable assemblies.

Referring to the drawings and particularly FIG. 1, a punching and exercise bag is illustrated generally designated by the reference character 10 supported on a generally vertical cable assembly 11 fixed at its upper end to a fixed support 13 and at its lower end to a fixed support 14. The bag assembly 10 generally includes an upper clamp assembly 16 releasably fixed to the cable assembly 11 and a lower clamp assembly 17 releasably fixed to the same cable assembly 11 to hold the bag assembly 10 in a variety of vertical positions along the cable assembly 11.

Figure 2:
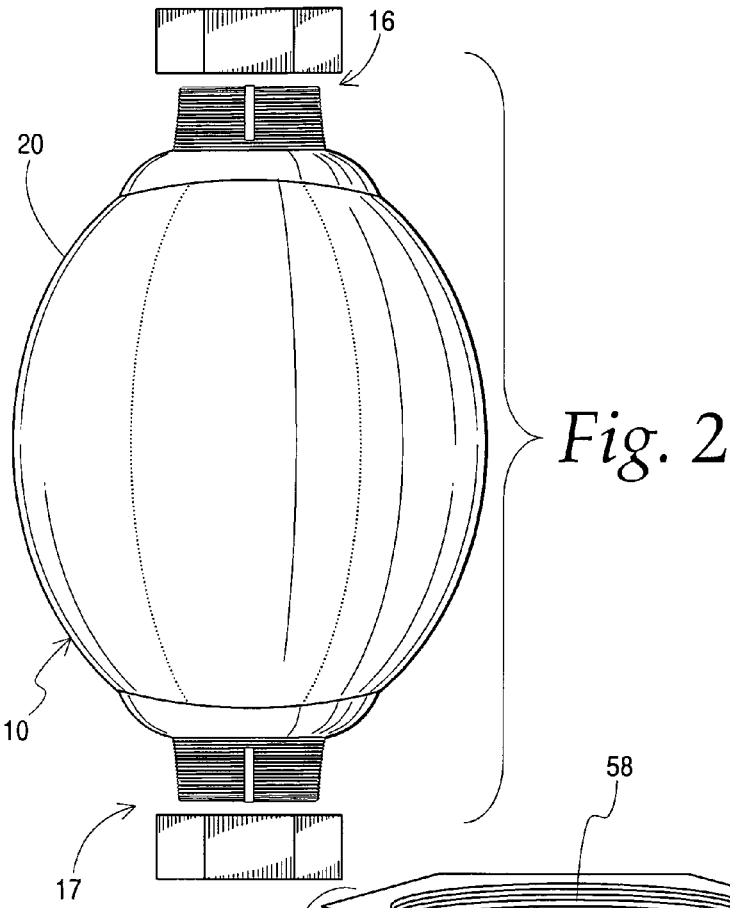
FIG. 2 is an exploded view of the punching bag assembly illustrated in FIG. 1.

As seen in FIG. 2, the punching bag and exercise assembly 10 is seen to be generally spheroidal in configuration and includes an outer spheroidal leather layer 20 (see also FIG. 4) that may be real leather or a leather substitute and a complimentary spheroidal bladder assembly 22 as seen in FIG. 4. The bladder assembly 22, as seen in FIG. 4, includes an outer layer 24, an annular inner tube 26, and partitions 27, 28, 29 and 30 that separate the bladder 22 into air chambers 32, 33, 34 and 35, that receive air from an unshown air inlet check valve type fitting.

Figure 3:
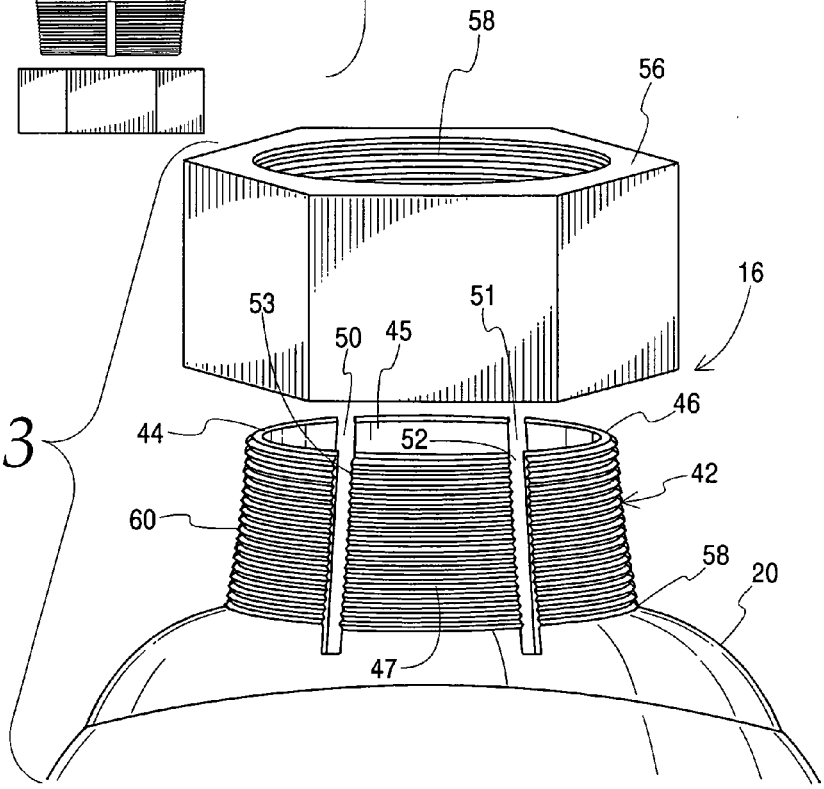
FIG. 3 is an exploded enlarged view of the upper cable clamp illustrated in FIG. 2.

As seen in FIGS. 2 and 3, each of the clamp assemblies 16 and 17 are identical, but reversed in direction and include an annular inner frusto-conical, tapered, split collet 42 consisting of four separate segments 44, 45, 46, and 47 spaced apart at 50, 51, 52, and 53 so that they have radial flexibility. The split collet 42, as well as the connecting compression nut 56, are constructed of a rigid thermoplastic material in the Shore D hardness range, and the flexibility of the annular collet 42 is achieved more by the split configuration of the collet 42 as opposed to the flexibility of the elastomer of which the collet 42 is composed, particularly since collet 42 is attached at 58 by a bonding process, to the outer leather layer 20 of the bag assembly 10. The outer surface of the collet 42 is threaded and is sized to receive threads 58 on the interior of the nut 56. The threads 58 are also tapered so that they mate with the threads 58 but are sized so that as the nut 56 is threaded on the collet 42, the segments 44, 45, 46 and 47, the segments will move inwardly as the nut 56 is threaded downwardly. The inner surface of the threads 58 on the nut 56 may be either annular in configuration with a diameter less than the lower diameter of threads 60 on the collet 42, or they may be frusto-conical in configuration with the lower threads less in diameter than the diameter of the lower threads 60 on the collet 42. As the nut 56 is threaded on the collet 42, the inner surfaces of the segments 44, 45, 46 and 47 move inwardly and engage and clamp on the cable assembly 11.

The clamp assemblies 16 and 17 are identical so it should be understood that the description above with respect to clamp assembly 16 applies to the clamp assembly 17 as well.

The invention claimed is:

1. A double-end punching and exercise bag, comprising: a bag assembly having a central opening extending completely therethrough, a cable extending completely through the central opening in the bag assembly having distal ends with fittings adapted to be connected to supports, said bag assembly being slidable on the cable, and a clamp assembly on the bag assembly adapted to fix the bag assembly in a variety of positions on the cable, wherein the clamp assembly includes an inner radially flexible tapered portion, and an annular axially movable outer member for radially moving the inner portion into engagement with the cable.

2. A double-end punching and exercise bag, comprising: a bag assembly having a central opening extending completely therethrough, a cable extending completely through the central opening in the bag assembly having distal ends with fittings adapted to be connected to supports, said bag assembly being slidable on the cable, and a clamp assembly on the bag assembly adapted to fix the bag assembly in a variety of positions on the cable, wherein the clamp assembly includes an inner radially flexible tapered portion, and an annular axially movable outer member for radially moving the inner portion into engagement with the cable, wherein the inner clamp portion and the annular outer member have interengaging threads.

3. A double-end punching and exercise bag, comprising: a bag assembly having a central opening extending completely therethrough, a cable extending completely through the central opening in the bag assembly having distal ends with fittings adapted to be connected to supports, said bag assembly being slidable on the cable, a clamp assembly on the bag assembly adapted to fix the bag assembly in a variety of positions on the cable, the clamp assembly including an inner radially flexible tapered portion, and an annular axially movable outer member for radially moving the inner portion into engagement with the cable, wherein the inner clamp portion and the annular outer member have interengaging threads.

4. A double-end punching and exercise bag, comprising: a bag assembly having a central opening extending completely therethrough, a cable extending completely through the central opening in the bag assembly having distal ends with fittings adapted to be connected to supports, said bag assembly being slidable on the cable, a clamp assembly on the bag assembly adapted to fix the bag assembly in a variety of positions on the cable, including two clamp assemblies one at each end of the bag assembly, the clamp assemblies including an inner radially flexible tapered portion, and an annular axially movable outer member for radially moving the inner portion into engagement with the cable, wherein the inner clamp portion and the annular outer member having interengaging threads, wherein the bag assembly includes an outer layer of leather-like material and an internal bladder, said central opening being defined by the internal bladder, said clamp assembly being attached to the leather-like outer layer.

5. A double-end punching and exercise bag as defined in claim 1, wherein the clamp assembly includes an inner radially flexible tapered portion, and an annular axially movable outer member for radially moving the inner portion into direct or indirect engagement with the cable.

* * * * *